US005947111A

United States Patent [19]

Neulander et al.

[11] Patent Number: 5,947,111

[45] Date of Patent: Sep. 7, 1999

[54] APPARATUS FOR THE CONTROLLED HEATING OF PROCESS FLUIDS

[75] Inventors: John I. Neulander, Alberta, Canada; George S. Millas, Houston, Tex.; Tommy H. Croasdale, Cypress, Tex.; Robert J. Giammaruti, Katy, Tex.

[73] Assignee: Hudson Products Corporation, Houston, Tex.

[21] Appl. No.: 09/070,426

[22] Filed: Apr. 30, 1998

[51] Int. Cl.[6] ..... F24C 3/00; F22B 37/42

[52] U.S. Cl. ..... 126/351; 126/374; 236/21 B; 236/15 BB; 165/104.14; 122/448.1

[58] Field of Search ..... 126/351, 374, 126/350 R, 634, 635, 636, 638, 116 A, 116 R; 165/104.14, 104.13, 104.11, 104.21, 104.19, 104.22; 236/20 R, 21 R, 21 B, 22, 23, 36, 15 BB; 237/19; 122/448.1, 448.3

[56] References Cited

U.S. PATENT DOCUMENTS

| | | | |
|---|---|---|---|
| H399 | 1/1988 | Johnson et al. | 165/47 |
| 837,499 | 12/1906 | Perkins et al. . | |
| 1,725,906 | 8/1929 | Gay . | |
| 2,286,654 | 6/1942 | Simpson et al. | 252/281 |
| 2,350,348 | 6/1944 | Gaugler | 62/125 |

(List continued on next page.)

FOREIGN PATENT DOCUMENTS

| | | | |
|---|---|---|---|
| 1118765 | 2/1982 | Canada | F28D 21/00 |
| 1123690 | 5/1982 | Canada | F28D 21/00 |
| 1182697 | 2/1985 | Canada | F22B 1/18 |
| 1264443 | 1/1990 | Canada | B01D 17/04 |
| 1290632 | 10/1991 | Canada | F28D 1/04 |
| 2081498 | 4/1994 | Canada | F28D 15/00 |
| 0141529B1 | 3/1960 | European Pat. Off. | B01D 17/04 |
| 0 141 529 A2 | 5/1985 | European Pat. Off. | B01D 17/04 |
| 1210907 | 3/1960 | France . | |
| 1 589 730A | 5/1981 | United Kingdom | F28D 5/00 |
| 2 091 755A | 8/1982 | United Kingdom | C01B 3/34 |

OTHER PUBLICATIONS

CH681044 A (GNOSIS), Online absract (WPI) with Drawing, an example of a heat pipe with temperature control means, Accession No. 93–027427 [04], 2 pp. —©Derwent Publications Ltd.

JP4281119A (MATSUSHITA), Online abstract (PAJ) with Drawing, an example of a heat pipe with temperature control means, 2 pp. —©Japanese Patent Office.

Gordon R. Bopp et al. "Thermal," published in *Oil and Gas Journal*, Mar. 10, 1986 Technology, pp. 60–62 and 64.

K. R. Ferguson et al. "Improving Heater Treater Fuel Efficiency," published in SPE (Society of Petroleum Engineers of AME), SPE 8304, date unknown.

(List continued on next page.)

*Primary Examiner*—Ira S. Lazarus
*Assistant Examiner*—Josiah Cocks
*Attorney, Agent, or Firm*—R. J. Edwards; Eric Marich

[57] ABSTRACT

An apparatus for the controlled heating of a process fluid has a heater, a process fluid vessel containing the process fluid, and a bundle of thermosyphons extending between a burner chamber of the heater and the process fluid inside the vessel for transferring heat from the heater to the process fluid. Burners in the burner chamber are controlled to maintain the bulk temperature of the process fluid $T_{BULK}$ substantially within an operating range defined by preset upper $T_{HIGH}$ and lower $T_{LOW}$ temperature setpoints. The burners can be turned on to maintain an outside metal temperature $T_{EVAP}$ of the evaporator ends of the thermosyphons above a preset dew point temperature $T_{DEW}$ to prevent corrosion. The burners can also be shut down if an outside surface temperature $T_{OD}$ of at least one of the condenser ends of the thermosyphons extending into the vessel exceeds a predetermined setpoint temperature $T_{ALARM}$. Different configurations of condenser ends of the thermosyphons in the vessel may be utilized to enhance heating the process fluid. The vessel and heater are separated and sealed from each other by a sealed chamber encasing the thermosyphons, which may also be used to preheat incoming combustion air for the burners.

12 Claims, 8 Drawing Sheets

U.S. PATENT DOCUMENTS

| | | | |
|---|---|---|---|
| 2,732,070 | 1/1956 | Glassgow et al. | 210/52.5 |
| 2,746,725 | 5/1956 | Reed | 257/6 |
| 2,779,143 | 1/1957 | Brooks | 53/25 |
| 2,868,313 | 1/1959 | Leuszler | 183/2.7 |
| 3,229,759 | 1/1966 | Grover | 165/105 |
| 3,318,448 | 5/1967 | Fryer | 210/71 |
| 3,406,244 | 10/1968 | Oktay | 174/15 |
| 3,468,300 | 9/1969 | Geyer et al. | 126/343.5 |
| 3,503,438 | 3/1970 | Geyer | 165/105 |
| 3,554,183 | 1/1971 | Grover et al. | 126/343.5 |
| 3,581,471 | 6/1971 | Waterman | 55/175 |
| 3,595,304 | 7/1971 | McHugh | 165/1 |
| 3,686,040 | 8/1972 | Grover et al. | 165/105 |
| 3,815,552 | 6/1974 | Koula | 122/33 |
| 3,848,187 | 11/1974 | Rohrback et al. | 324/65 |
| 3,854,454 | 12/1974 | Lazaridis | 122/33 |
| 3,865,184 | 2/1975 | Grover | 165/105 |
| 3,945,433 | 3/1976 | Koula | 165/39 |
| 3,948,245 | 4/1976 | van der Sluys | 126/263 |
| 4,020,898 | 5/1977 | Grover | 165/105 |
| 4,067,237 | 1/1978 | Arcella | 73/704 |
| 4,067,315 | 1/1978 | Fehlner et al. | 126/271 |
| 4,105,895 | 8/1978 | Kennedy | 219/326 |
| 4,131,785 | 12/1978 | Shutt | 219/326 |
| 4,146,176 | 3/1979 | Beauvais et al. | 237/12.3 |
| 4,183,399 | 1/1980 | Seehausen | 165/103 |
| 4,224,925 | 9/1980 | Movick | 126/427 |
| 4,226,282 | 10/1980 | Kunsagi et al. | 165/106 |
| 4,252,772 | 2/1981 | Way | 422/244 |
| 4,254,826 | 3/1981 | Adams | 165/143 |
| 4,267,825 | 5/1981 | Ward | 126/433 |
| 4,280,554 | 7/1981 | Stockman | 165/11 |
| 4,312,402 | 1/1982 | Basiulis | 165/104 |
| 4,329,159 | 5/1982 | Bull | 55/42 |
| 4,342,572 | 8/1982 | Heath | 55/60 |
| 4,382,466 | 5/1983 | Shiraishi | 165/104 |
| 4,394,344 | 7/1983 | Werner et al. | 376/146 |
| 4,414,462 | 11/1983 | Price | 219/202 |
| 4,426,959 | 1/1984 | McCurley | 165/1 |
| 4,440,215 | 4/1984 | Grover et al. | 165/104.21 |
| 4,441,544 | 4/1984 | McCurley | 165/1 |
| 4,482,004 | 11/1984 | Grover | 165/1 |
| 4,485,865 | 12/1984 | McCurley | 29/157.4 |
| 4,488,344 | 12/1984 | McCurley | 29/157.4 |
| 4,520,863 | 6/1985 | Andres et al. | 165/48 |
| 4,621,681 | 11/1986 | Grover | 165/47 |
| 4,640,347 | 2/1987 | Grover et al. | 165/104.26 |
| 4,706,355 | 11/1987 | Kuhns et al. | 29/157.3 |
| 4,854,148 | 8/1989 | Mayer | 72/68 |
| 4,971,142 | 11/1990 | Mergler | 165/104.14 |
| 5,033,539 | 7/1991 | Kohtaka | 165/104.14 |
| 5,046,553 | 9/1991 | Lindner | 165/104.26 |
| 5,085,270 | 2/1992 | Counterman et al. | 165/95 |
| 5,101,888 | 4/1992 | Sprouse et al. | 165/104.26 |
| 5,379,831 | 1/1995 | Carpenter | 165/104.27 |
| 5,579,828 | 12/1996 | Reed et al. | 165/83 |
| 5,653,284 | 8/1997 | Giammaruti et al. | 165/162 |

OTHER PUBLICATIONS

T. F. Irvine, Jr. and J.P. Hartnett, Excerpt from *Advances in Heat Transfer*, vol. 9, Academic Press NY ©1973,pp. 1–111.

S. W. Chi, *Heat Pipe Theory and Pratice—A Sourcebook*, ©1976, Hemisphere Publishing Corporation, pp. i–xiv; 1–9; 14–21; 28–33; 213–227.

Alan J. Chapman, *Heat Transfer*, Third Edition, Macmillan Publishing Co., Inc., NY ©1974, pp. 566–572.

S. van Stralen and Robert Cole, *Boiling Phenomena Physiochemical and Engineering Fundamentals and Applications*, vol. 2, Hemisphere Publishing Corp., pp. 923–933.

EPRI NP–2648, EPRI Interim Report, Nov. 1982, "Reflux Condensation and Operating Limits of Countercurrent Vapor–Liquid Flows in a Closed Tube,", prepared by Univ. of CA at Berkeley.

Brochure by Hudson Products Corporation, ©1986 McDermott Incorporated Entitled *Heat Pipe Air Heaters—The Smart Way to Save Money and Energy*.

H. N. Franklin and F. M. Talmud "Economics of heat Pipe Air Preheater for Primary Air Systems," presented at the Joint Power Generation Conference in St. Louis, MO, Oct. 1981.

"Advances in Heat Pipe Science and Technology," *Proceedings of the IX International Heat Pipe Conference*, May 1–5, 1995, Albuquerque, New Mexico, vol. 1.

*Encyclopedia of Chemical Technology* fourth Edition, vol. 12, Fuel Resources to Heat Stabilizers, A. Wiley–Interscience Pblication © 1994,, pp. 1011–1021.

G.Yale Eastman, "The Heat Pipe," *Sci. Am.* 218, No. 5, 1968, pp. 38–46.

K. Thomas Feldman, Jr. and Glen H. Whiting, "The Heat Pipe," published in *Mechanical Engineering*, Nov. 1968, pp. 48–53.

"Heat Pipe Types and Applications," author, date and publication unknown.

P. Dunn and D.A. Reay, "Het Pipe Third Edition,"Pergamon Press 1982, pp. 1–5.

P. Dunn and D. A. Reay, "Heat Pipes Second Edition," Pergamon Press 1978, pp. 1–3.

Z. R. Gorbis and G. A. Savchenkov, "Low Temperature Two–Phase Clsoed Thermosyphon Investigation ," source unknown.

M. Shiraishi et al., "Investigation of Heat Transfer Characteristics of a Two–Phase Closed Thermosyphon," source and date unknown.

H. Nguyen–Chi et al., "Entertainment of flooding Limit in a Closed Two–Phase Thermosyphon," source and date unknown.

Ashrae Systems abd Equipment Handbook, 1996, pp. 42. 14–42.18.

Excerpts from Federal Reporter: Hamilton v. United States 167 F. pp. 796, A. H. Ringk & Co. v. United States 164 F. pp. 1021, United States v. Deutsch 178 F pp. 272.

Amir Faghri, Taylor & Francis, *Heat Pipe Science and Technology*, 1995, pp. 10–12.

Z. Najat "Maximum Heat Flux for Countercurrent Two Phase Flow in a Closed End Vertical Tube,"published in *Heat Transfer 1978 Transfert De Chaleur 1978*, vol. 1, Hemisphere Publishing Corp., pp. 441 and 444.

K. Arnold and M. Stewart "Surface, Production Operations," published in vol. 1 *Design of Oil Handling Systems and Facilities*, pp. 61–66.

K. Arnold and M. Stewart "Surface Production Operations," published in vol. 1 *Design of Oil–Handling Systems and Facilities*, pp. 164–170.

"Heat Exchangers Target Enviromental Control" published in *Chemical Engineering*, Jun.1995, author unknown.

K. Thomas Feldman, Jr. and S. Munje "Experiments with Gravity Assisted Heat Pipes with an Without Circumferential Grooves," ©American Institute of Aeronautics and Astronautics, Inc. 1978, pp. 15–20.

G. Bartsch, J. Brito, and D. Schroeder–Richter "Heat Transfer Coefficient of Pool Boiling within the Heating Zone of a Two–Phase Closed Thermosiphon," 1993, pp. 99–104.

B. F. Balunov, Y. N. Ilyukhin, V. I. Kiselev, D. G. Govyadko "The Requisite Degree of Filling and the Limiting Capacity of a Two–Phase Thermosiphon" published in *Thermal Engineering*, 39, 1992, pp. 452–455.

H. M. Franklin, "Building a Better Heat Pipe" published in *Mechanical Engineering*, Aug. 1990, pp. 52–54.

Brochure entitled "heatflo —Heat Pipe Air Heaters" by Hudson Products Corporation —©1996 McDermott Incorporated.

R. J. Giammaruti and F. G. Russell, "Operating Experience with Two Water/Carbon Steel Heat Pipe Air Heaters", Technical Paper, dat unknown.

EPRI Report Summary, EPRI TR–102564 Research Project 1403–58, Final Report, Jun. 1993, prepared by Yankee Scientific, Inc., Principal Investigator: E. C. Guyer. ©1993 EPRI.

APPARATUS FOR THE CONTROLLED HEATING OF PROCESS FLUIDS

FIELD AND BACKGROUND OF THE INVENTION

The present invention relates generally to the field of heat transfer and in particular to a new and useful apparatus for heating a process fluid using thermosyphons.

It is well known to heat process fluids, such as crude oil, emulsions, amine, etc. using a fire tube heater system. An example of such a system is shown in FIG. 1. The fire tube stack 12. The finned evaporator ends 11 of the heat pipes 5 are heated in the combustion chamber 6 to cause the working fluid in each heat pipe 5 to travel to their condenser ends 13 which are immersed in the oil-water emulsion 8 in the vessel 1, where heat is released to the oil-water emulsion 8. The heat pipes 5 thus transfer heat into the oil-water emulsion 8 and hasten its separation into free gas which exits via gas discharge pipe 14, treated oil which exits via treated oil outlet 15, and water which exits via water drain 16.

The heat pipe system in Canadian Patent No. 1,264,443 does not disclose particular connections between the heat the process fluid vessel at an existing flange. The header box contains two seals through which the thermosyphon bundle passes. The seals separate the burner chamber from the process fluid and the portion of the header box adjacent the burner chamber can function as a preheater for the combustion air to the burners.

In the case of a retrofit, the thermosyphon bundle is supported inside the process fluid vessel using existing fire tube supports. The condenser ends of the thermosyphons inside the process fluid vessel may be arranged in a close bundle, or they may be separated into different patterns to maximize the heat transfer from the thermosyphons into the process fluid.

More particularly, one aspect of the present invention is drawn to an apparatus for controlled heating of a process fluid. The apparatus comprises a heater having a burner chamber, a burner array in the burner chamber, and means for providing combustion air to the burner array. A process fluid vessel contains the process fluid. A plurality of thermosyphons having evaporator ends and condenser ends are provided. The evaporator ends are arranged in a closely spaced bundle within the burner chamber in close proximity to the burner array, while the condenser ends extend into the process fluid vessel. During normal operation, the condenser ends of the thermosyphons are immersed in the process fluid. The evaporator ends receive heat generated by the burner array within the burner chamber, and the heat is transferred through the thermosyphons to their condenser ends which are arranged in a wide open, spread-out configuration to release heat into the process fluid in the process fluid vessel. Finally, burner controller means are provided for controlling an amount of fuel supplied from a fuel source to the burner array in response to sensed temperatures. The burner controller means performs several functions, one of which is to shut off a flow of fuel to the burner array when a sensed temperature $T_{OD}$, corresponding to an outside diameter outside surface temperature of at least one of the condenser ends of the thermosyphons extending into the process fluid vessel, exceeds a predetermined setpoint temperature $T_{ALARM}$.

Another function of the burner control means is to turn on or increase fuel to the burner array when a sensed temperature $T_{EVAP}$, corresponding to an outside diameter metal surface temperature of at least one of the finned evaporator ends of the thermosyphons located above the burner array, drops below a predetermined setpoint temperature $T_{DEW}$. The setpoint temperature $T_{DEW}$ corresponds to the minimum metal temperature at which the water or sulfuric acid dew-point of the combustion gases occurs.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
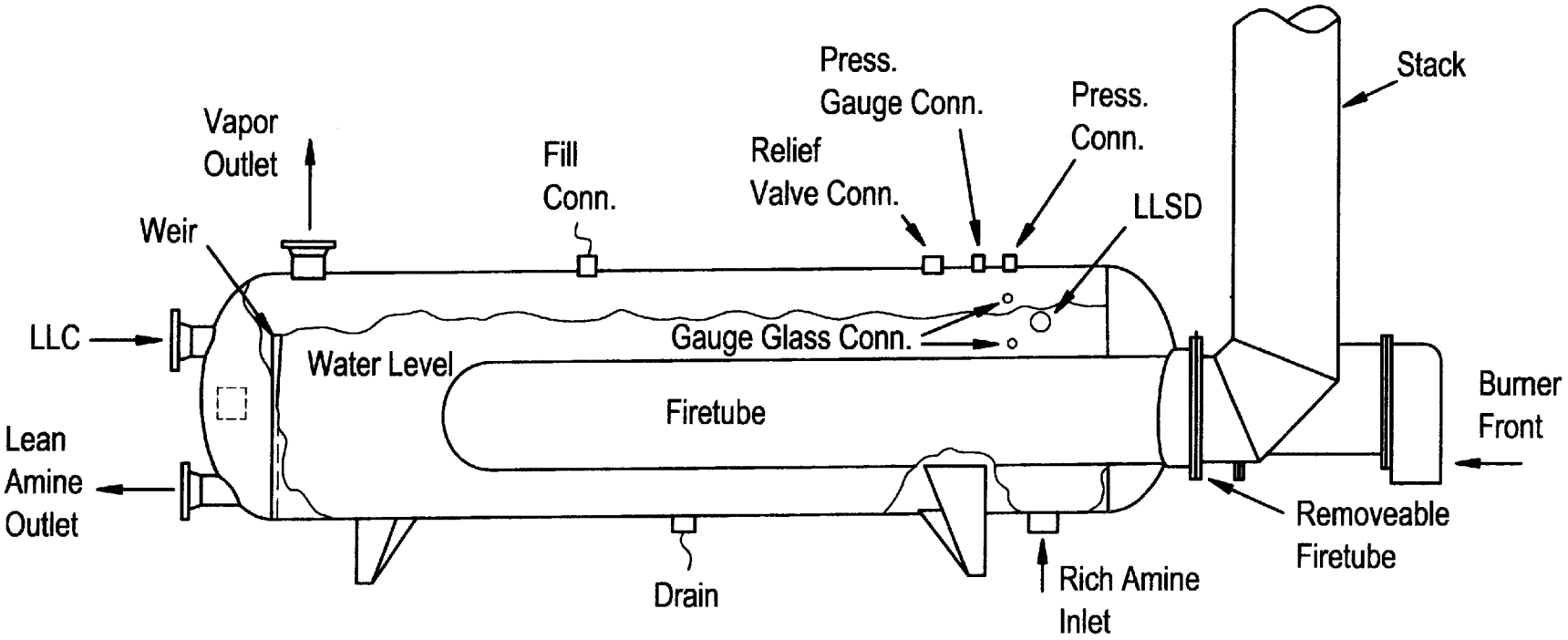
FIG. 1 Prior Art
FIG. 1 is an illustration of a known, U-shaped fire tube heater system.
Figure 2:
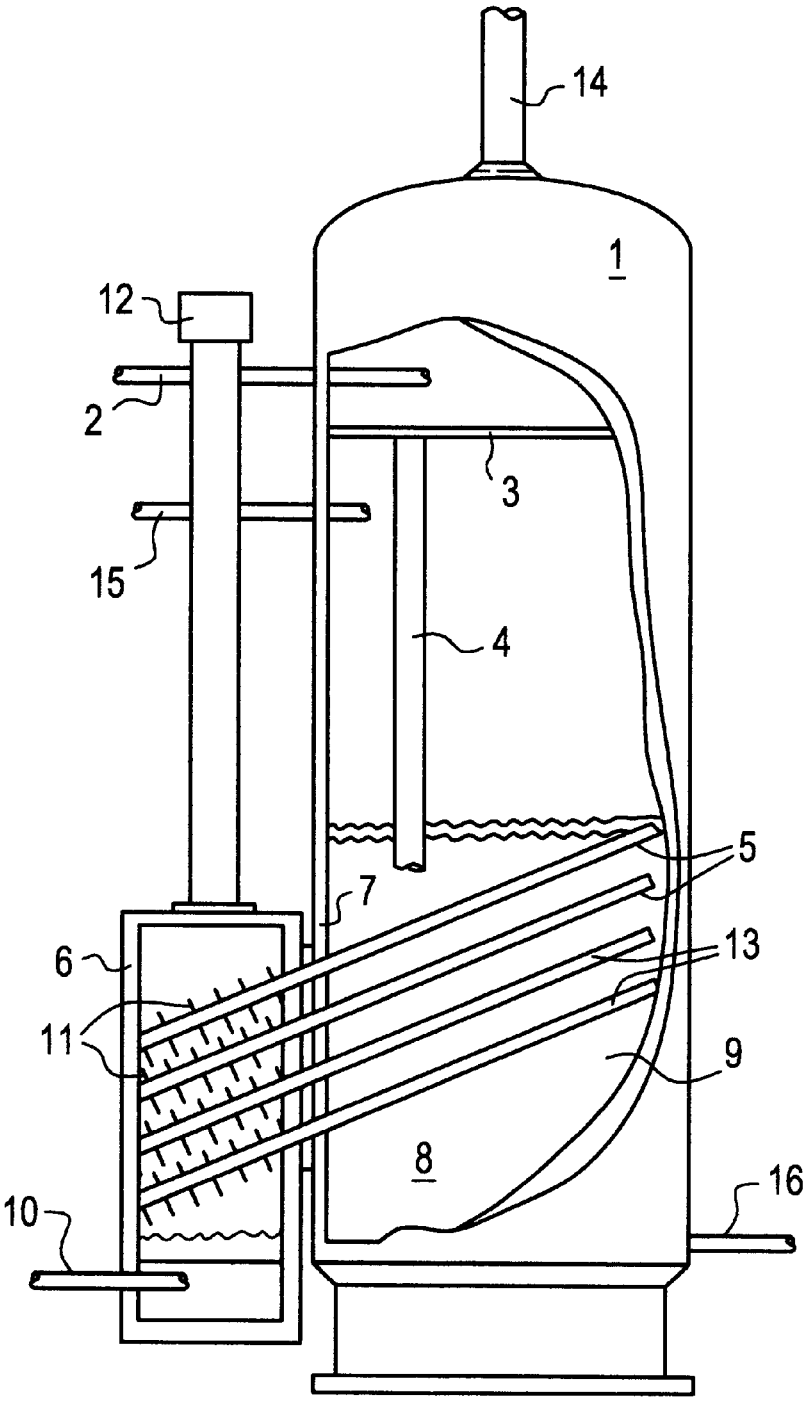
FIG. 2 Prior Art
FIG. 2 is an illustration of a known system for separating an oil-water emulsion which has a heat pipe bundle extending between a combustion chamber and a vessel containing the oil-water emulsion.
Figure 3:
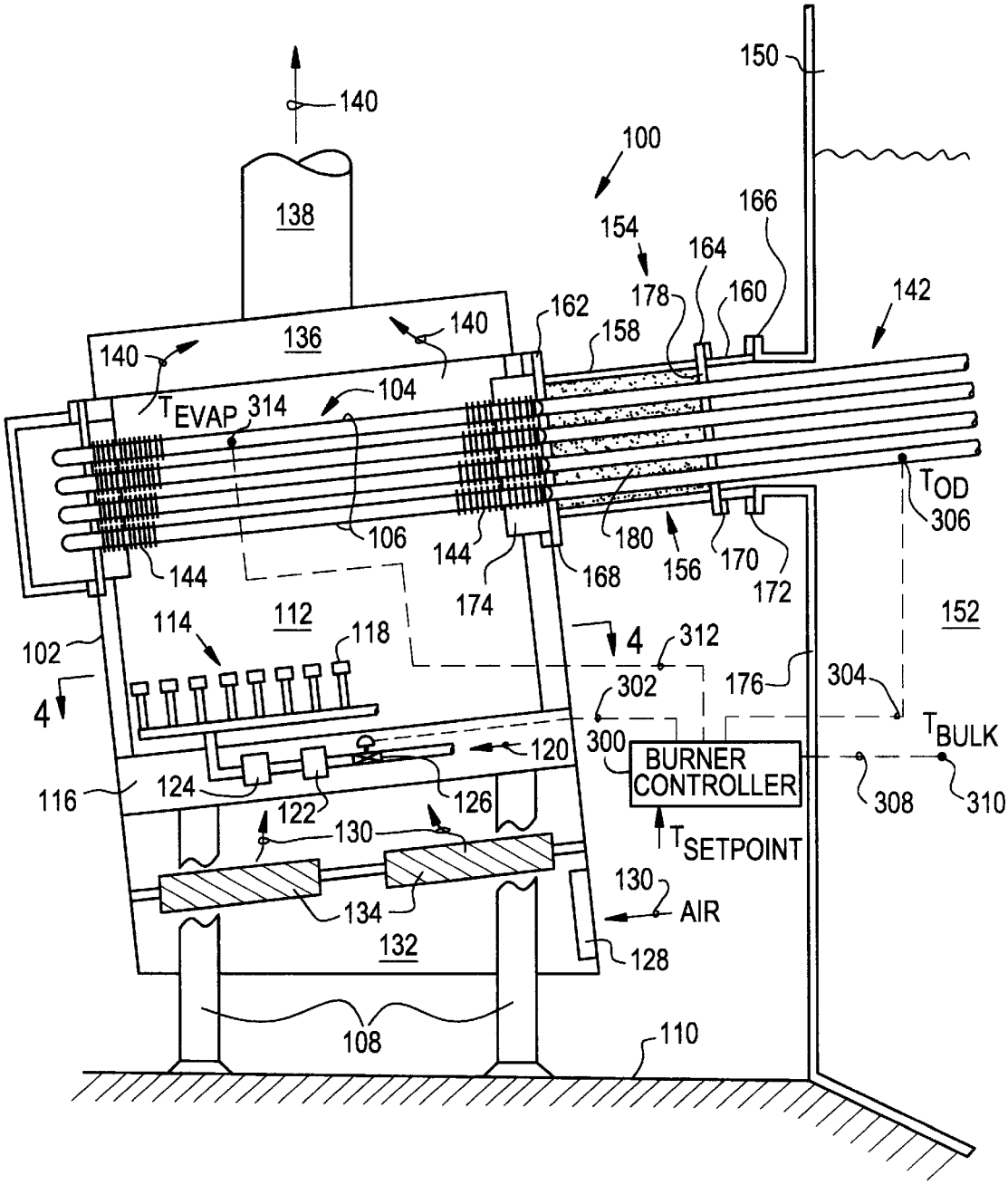
FIG. 3 is a partial sectional side elevational view of a first embodiment of the apparatus of the invention as applied to a substantially vertical process fluid tank or vessel.

Referring to the drawings generally, wherein like reference numerals designate the same or functionally similar elements throughout the several drawings, FIG. 3 discloses a process fluid heating apparatus, generally designated 100, which has a heater 102 surrounding evaporator ends 104 of a bundle of thermosyphons 106. Heater 102 is supported by supports 108 at its lower end above the ground 110. The supports 108 provide a slightly inclined orientation to the heater 102 relative to the ground 110.

Figure 4:
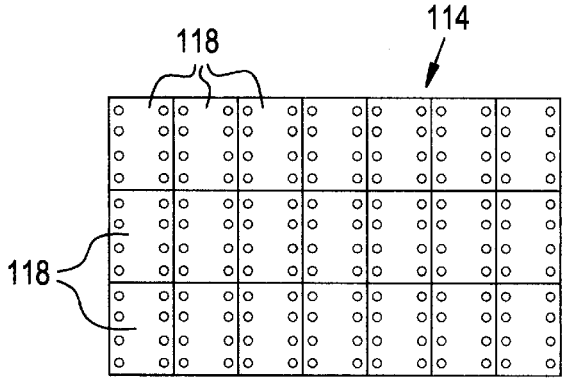
FIG. 4 is a top plan view of a burner array for use in the apparatus of FIG. 3, viewed in the direction of arrows 4—4.

The heater 102 has a burner chamber 112 enclosing the evaporator ends 104 above a burner array 114 located within a burner skirt 116 at a base of the burner chamber 112. Burner array 114 is comprised of several burner elements 118 arranged close together to maximize the area covered by the burner array 114. One possible burner array 114, as seen in FIG. 4, has three rows of burner elements 118 adjacent each other. Preferably, the burner elements 118 are T-type burners or up shot burners of a type known to those skilled in the burner arts.

Burner array 114 is supplied by fuel supply 120 with natural gas, propane, or casing gas. Casing gas is a product of oil wells that is usually vented to atmosphere since it cannot be burned in conventional, high pressure (15 to 30 psig) burners because it is dirty, wet, and contains particulates which erode such conventional burner components. First and second stage pressure regulation elements 122, 124 of known design would be provided as necessary, as would a manual or motor operated gas valve means 126. Gas valve means 126 could be of the on-off type or modulating, as described below. Air inlet 128 admits combustion air 130 into a plenum 132. Flame arrestors 134 allow the combustion air 130 to pass through the plenum 132 and mix with the fuel provided by burner array 114 located within the burner chamber 112. An exhaust chamber 136, exhaust stack 138, and a vent hood (not shown) are provided above the thermosyphons 106 in the burner chamber 112 to permit combustion gases 140 to leave the burner chamber 112 via natural draft.

Inside the burner chamber 112, the evaporator ends 104 of the thermosyphons 106 are heated, causing a working fluid inside each thermosyphon 106 to gain heat energy, evaporate, and travel up and through the thernosyphons 106 to their condenser ends 142 which are located inside a substantially vertical process fluid tank or vessel 150 and immersed in a process fluid 152 therein to be heated. Thermosyphons 106 are oriented at approximately the same angle of inclination as the heater 102, so that the condenser ends 142 of the thermosyphons 106 are elevated above evaporator ends 104 of the thermosyphons 106. The evaporator ends 104 of the thermosyphons 106 may each have a plurality of fins 144 attached to increase their thermal surface area and enhance the heat transfer between the combustion gases 140 and the evaporator ends 104 of the thermosyphons 106.

A transition box 154 surrounds a middle section 156 of the thermosyphons 106 extending between the heater 102 and the process fluid tank or vessel 150. Transition box 154 has a first (preheat) section 158 and a second section 160 connected to one another and to the burner chamber 112 at flanged connections 162, 164, and 166. A gasket or seal is provided at 168, but may or may not be provided at locations 170 and 172. Preheat section 158 is adjacent heater 102 but separated from burner chamber 112 by a packing box 174. Half of flanged connection 172 is preferably part of the process fluid tank or vessel 150 and it may be either flush with a wall 176 of the process fluid tank or vessel 150, or horizontally offset therefrom as shown in FIG. 3. Second section 160 is open to the process fluid 152 and interconnects the process fluid tank or vessel 150 at flanged connection 166 and the preheat section 158 at flanged connection 164. A divider plate 178 is used to divide first section 158 from second section 160 so that only the thermosyphons 106 can pass through each section and so that the process fluid tank or vessel 150 and heater 102 are otherwise isolated from each other. This isolation prevents any of the process fluid 152 from leaking into burner chamber 112 and possibly being ignited if process fluid 152 is flammable. Both the first preheat section 158 and the second section 160 may be packed with insulation 180 to minimize heat loss to the surroundings, thereby maximizing the heat that is conveyed along thermosyphons 106 to their condenser ends 142 immersed in the process fluid 152. In an alternative configuration, described below, the insulation 180 can be omitted to allow the first section 158 to serve as a preheating chamber for preheating the combustion air 130.

Figure 5:
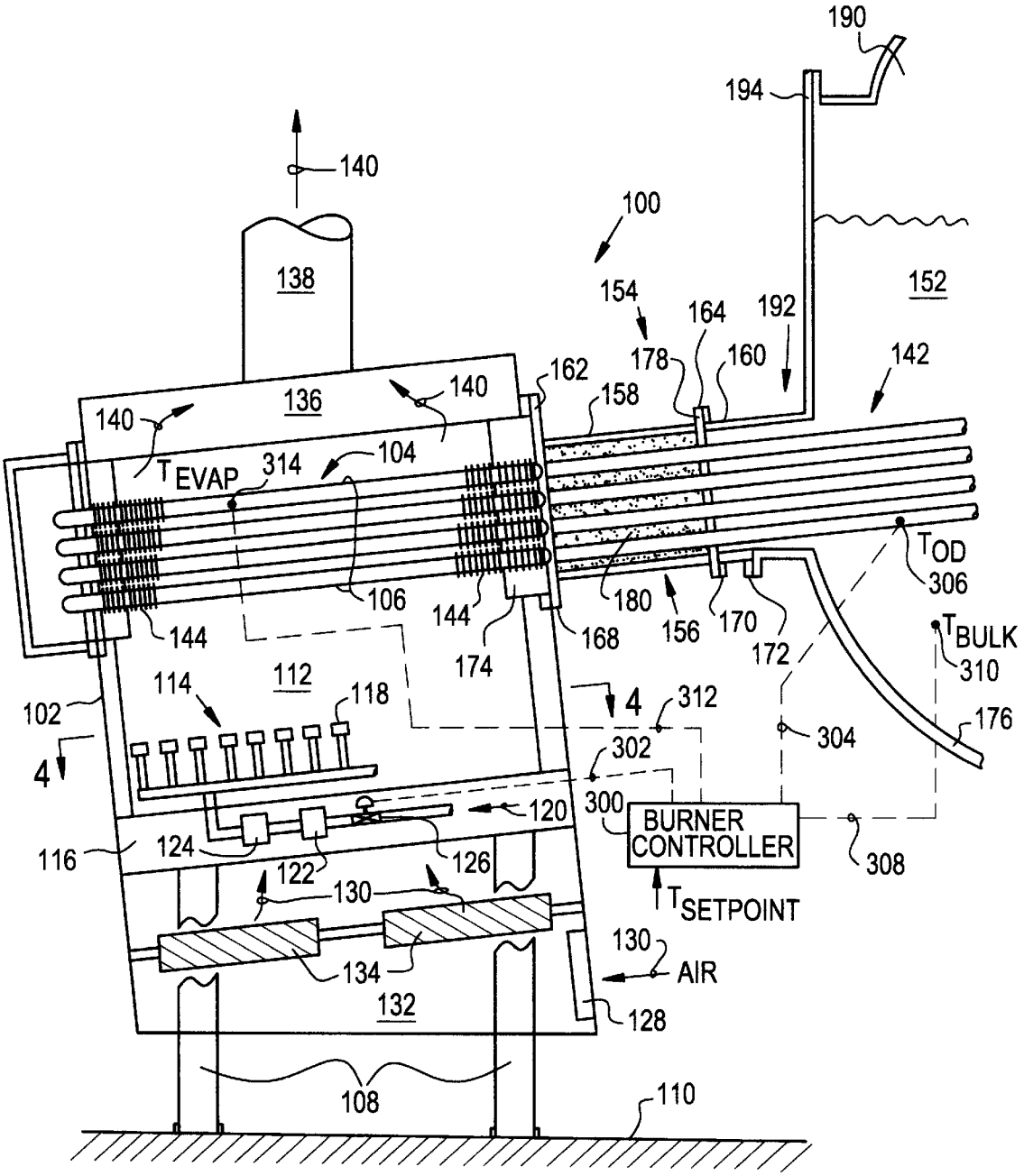
FIG. 5 is a partial sectional side elevational view of a second embodiment of the apparatus of the invention as applied to a substantially horizontal process fluid tank or vessel.

FIG. 5 illustrates the application of the present invention to the task of heating a process fluid 152 contained within a substantially horizontal process fluid tank or vessel 190. Again, like reference numerals designate the same or functionally similar elements. This arrangement is quite similar to that shown in FIG. 3, but there are some differences. For example, there is shown in FIG. 5 a 5-high arrangement of thermosyphons 106, in contrast to the 4-high arrangement of thermosyphons 106 shown in FIG. 3. It will be understood that various thermosyphon 106 configurations may be employed, preferably in a staggered configuration, in either the FIG. 3 or FIG. 5 embodiments. Further, the thernosyphons 106 in the FIG. 5 embodiment only penetrate a lower portion 192 of a flanged cover plate 194 on the process fluid tank or vessel 190. The flanged cover plate in FIG. 5 serves substantially the same purpose and performs substantially the same function as the second section 160 of transition box 154 of FIG. 3. As is the case with the embodiment of FIG. 3, the required heat transfer duty will determine how many thermosyphons 106 will be needed, and this will likewise determine how much of an opening will be required in the flanged cover plate 194.

Figure 6:
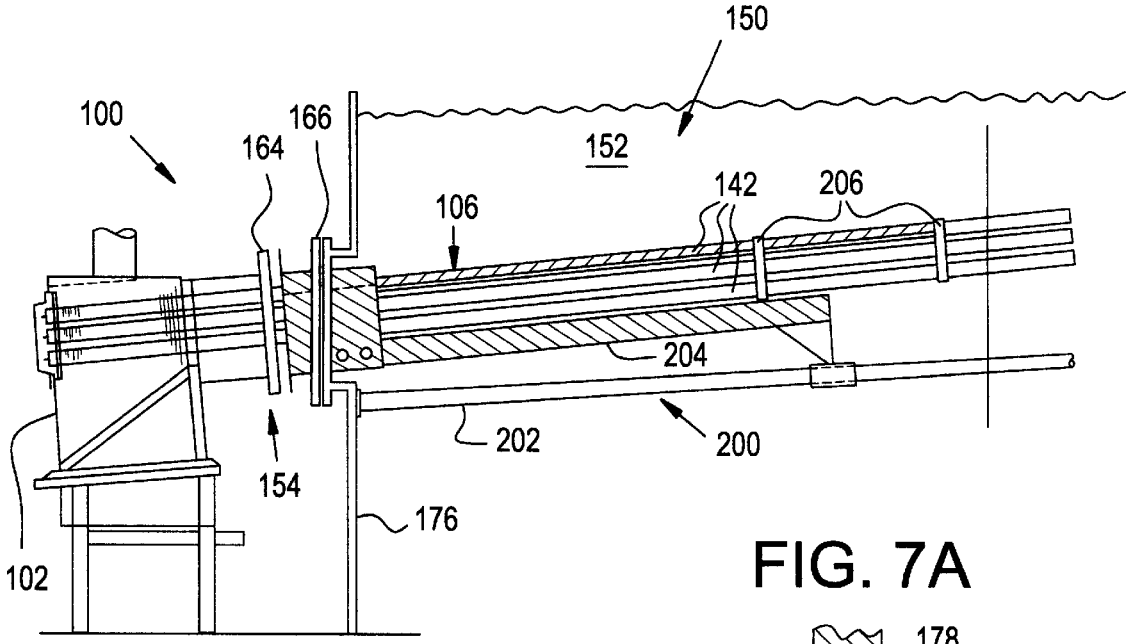
FIG. 6 is a partial sectional side elevational view of the apparatus inside the process fluid tank or vessel.

In FIG. 6, a typical existing support structure 200 in tank or vessel 190 is used to support the condenser ends 142 of the thermosyphons 106 as shown, modified to support the condenser ends 142 of the thermosyphons 106. In the case where a pre-existing process fluid tank or vessel 150 is modified to be heated by the apparatus of the invention, an existing fire tube support 202 may be used as part of the support structure 200. Additional tube bundle slide-in supports 204 are linked to the existing fire tube support 202, together with tube bundle fixed supports 206. In the case of new systems, a similar support structure 200 may be used, but it may be more specifically tailored to the vessel 150, 190 and the arrangement of thermosyphons 106 used inside the process fluid tank or vessel 150, 190.

Figure 7A:
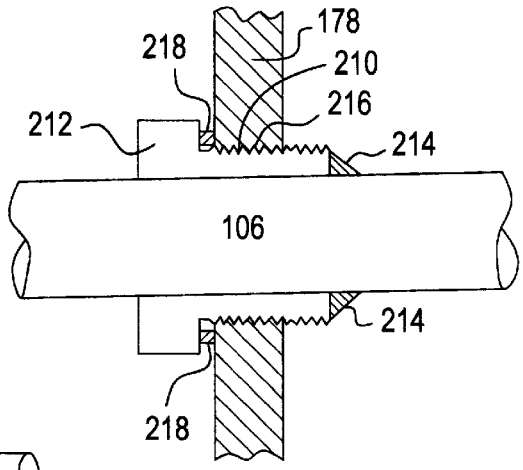
FIG. 7A is a partial sectional side elevational view of one embodiment of a thermosyphon seal connection.
Figure 7B:
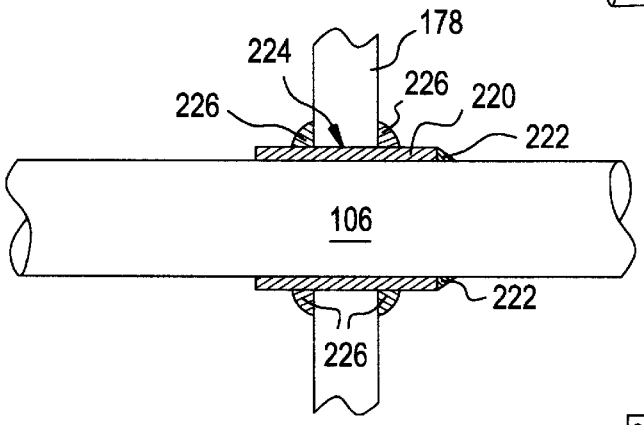
FIG. 7B is a partial sectional side elevational view of another embodiment of a thermosyphon seal connection.
Figure 7C:
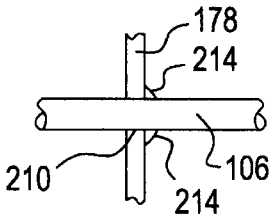
FIG. 7C is a partial sectional side elevational view of yet another embodiment of a thermosyphon seal connection.

FIGS. 7A, 7B, and 7C show preferred embodiments for providing the thermosyphons 106 through divider plate 178, the first preheat section 158, and the second section 160 of the transition box 154 between the heater 102 and the process fluid tank or vessel 150, 190. The divider plate 178 has a plurality of openings 210 through which the thermosyphons 106 are inserted.

In the embodiment shown in FIG. 7A, a threaded collar 212 is welded to each thermosyphon 106 by a seal weld 214. Threaded collar 212 is secured within the opening 210 in divider plate 178 by means of intercooperating threads 216 and sealed against the outside of the divider plate 178 by gasket 218. This configuration allows the thermosyphons 106 to be easily removed for inspection or replacement, if needed.

In the embodiment FIG. 7B, a seal collar 220 is sealedly positioned at 222, such as by a seal weld 222, around each thermosyphon 106 and then tightly fit in an opening 224 through divider plate 178. Seal welds 226 are then made between divider plate 178 and collar 220. This configuration is more permanent, since the seal welds 226 must be removed in order to remove the thermosyphons 106 and their seal collar 220.

Finally in the embodiment of FIG. 7C, there is shown the simplest means for sealing the thermosyphon tube 106 in a divider plate 178, namely by the provision of only the seal weld 214 directly between these two elements. This configuration is also somewhat permanent, since the seal weld 214 must be removed in order to remove the thermosyphons 106 from the divider plate 178.

Figure 8:
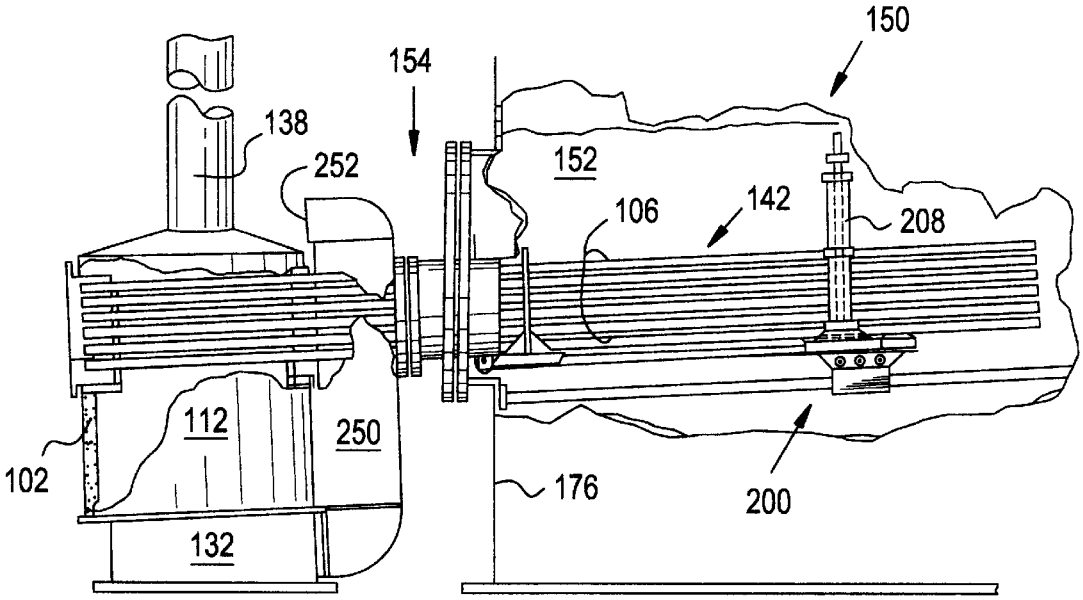
FIG. 8 is partial sectional side elevational view of a third embodiment of the apparatus of the invention.

FIG. 8 illustrates a third embodiment of the present invention, in the setting wherein it is applied to a substantially vertical process fluid tank or vessel 150, wherein an elongated preheat air duct 250 is attached to the plenum chamber 132 and extends along the side of heater 102 and around a portion of the thermosyphons 106. Air duct inlet 252 is above thermosyphons 106, so that air entering the air duct 250 must pass by the thermosyphons 106 in a section which is separated from both the burner chamber 112 and process fluid 152. In this embodiment, the transition box first preheat section 158 would not be insulated. Instead, the combustion air 130 receives some heat from the thermosyphons 106, warming the incoming combustion air 130 thereby preventing freezing and improving the combustion process occurring inside burner chamber 112. A double seal system is still used, with seal section 158 and 160 maintaining separation between the process fluid tank or vessel 150, 190 and burner chamber 112. FIG. 8 also illustrates another aspect of the thermosyphon tube bundle supports, wherein adjustable tube bundle supports 208 can be employed; this aspect is also illustrated in FIG. 9, wherein these adjustable supports 208 can be used to support different groups of thermosyphon tubes 106.

Figure 9:
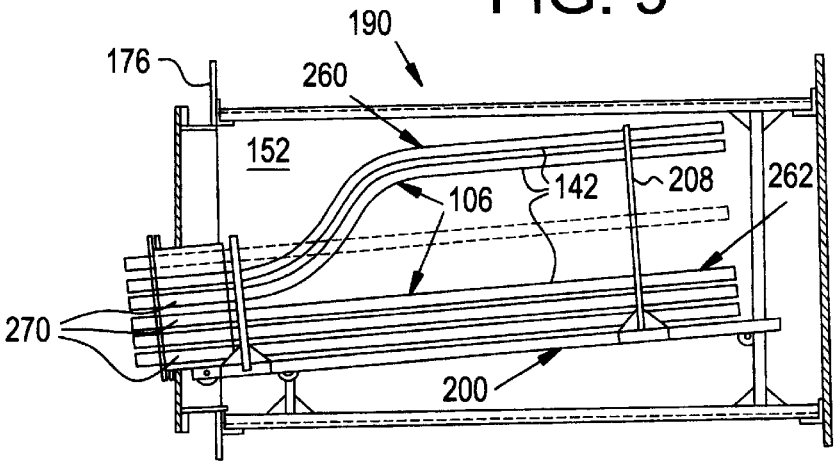
FIG. 9 is a sectional side elevational view of an alternate tube bundle arrangement inside the process fluid tank or vessel.

FIG. 9 has an alternative arrangement of the thermosyphons 106 within process fluid tank or vessel 150, 190. Depending on the nature of the process fluid 152 being heated, it may be more advantageous to separate the condenser ends 142 of the thermosyphons 106 to enable more even heating within the process fluid tank or vessel 150, 190. The condenser ends 142 of an upper group 260 of thermosyphons 106 are elevated above the remainder or lower group 262 of the bundle of thermosyphons 106 in this configuration. Depending on the configuration and arrangement of the thermosyphons 106, the support structure 200 may be modified accordingly to prevent undesirable bending or breaking of the thermosyphons 106 from stresses exerted by the process fluid 152 or the weight of the thermosyphons 106.

Figure 10A:
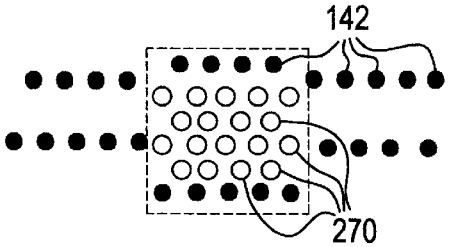
FIGS. 10A–10C are schematic diagrams showing alternate tube bundle arrangements inside the process fluid tank or vessel.
Figure 10B:
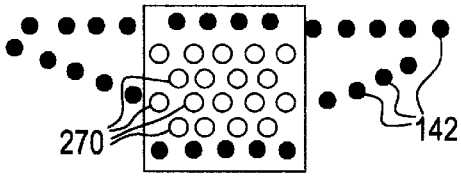
Figure 10C:
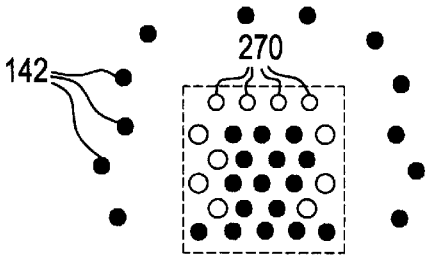
Figure 11:
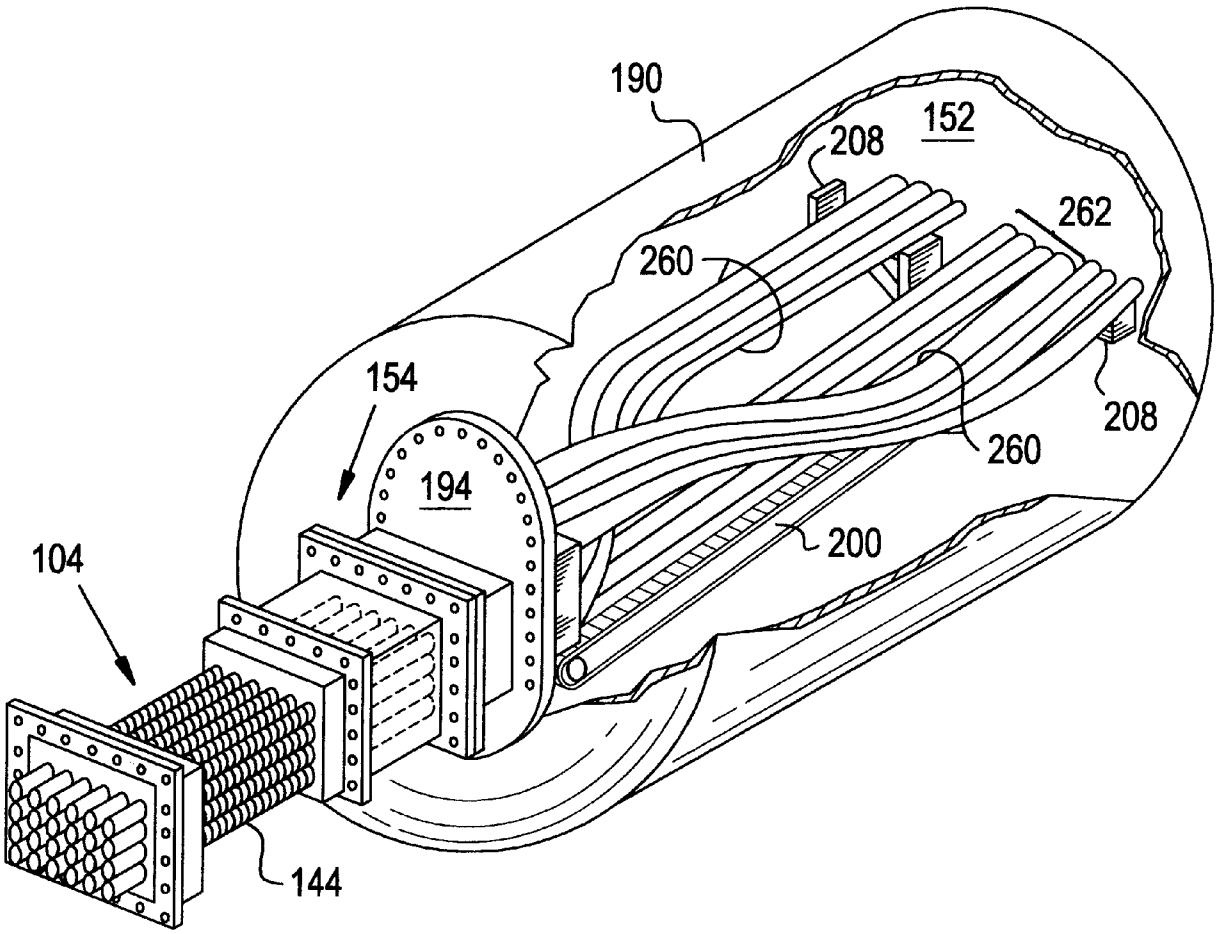
FIG. 11 is a perspective view, partly in section, of the arrangement of FIG. 9.

FIGS. 10A, 10B and 10C each display diagrams of some, but not all, of various positions of the condenser ends 142 of the thermosyphons 106 within the process fluid tank or vessel 150, 190 relative to a position 270 of the thermosyphons 106 as they enter the process fluid tank or vessel 150, 190. The shaded circles represent the condenser ends 142 of the thermosyphons 106, while the open circles represent the position 270 of the thermosyphons 106 adjacent the seal chamber 160 with the process fluid tank or vessel 150, 190 and as positioned within the burner chamber 112. As can be seen, the condenser ends 142 may be arrayed in wider spaced apart arrays, relative to a spacing of the evaporator ends 104 of the thermosyphons in the burner chamber 112, such as spaced apart horizontal rows across the width of the process fluid tank or vessel 150, 190, in inclined rows, or in arcuate configurations (FIGS. 10A, 10B, 10C, respectively). These configurations have several advantages, including: more uniform heating of the process fluid 152; a greater heat retention time for the process fluid 152; and a lessening of the possibility of overheating the process fluid 152 in a particular region. This is accomplished while maintaining a relatively "tight" tube-to-tube spacing and position 270 of the thermosyphons 106 in the burner chamber 112 which is required for adequate gas side heat transfer. FIG. 11 illustrates a perspective view, partly in section, of the arrangement of FIG. 9.

Other advantages of the invention include the ability to provide between two and three times the process fluid 152 side (condenser ends 142) heat transfer area as a conventional fire tube arrangement in the same volume within the process fluid tank or vessel 150, 190. When the different orientations of the thermosyphon condenser ends 142 are used, they have the effect of allowing the process fluid 152 to freely move about the thermosyphons 106 to release heat. Meanwhile, the close bundle of the thermosyphons 106 in the burner chamber 112 forces the hot combustion gases 140 to travel in a tortuous path around the thermosyphon evaporator ends 104, releasing their heat to the thermosyphons 106 as the gases move toward the exhaust chamber 136 and out exhaust stack 138.

Since the apparatus 100 is designed for the controlled heating of process fluids 152, means must be provided for controlling the heat input into the process fluid 152 to achieve a desired process fluid temperature. As schematically indicted in FIGS. 3 and 5, burner controller means 300 may be provided for this purpose, operatively interconnected via lines 302 and 304 to the gas valve means 126 and a first temperature sensor 306, respectively. The burner controller means 300 may advantageously be microprocessor based, and provided with means for inputting and changing particular temperature setpoints $T_{SETPOINT}$ by a human operator. To accomplish the task of controlling a bulk temperature $T_{BULK}$ of the process fluid 152, a second temperature sensor 310 would be provided, connected to the burner controller means 300 via line 308, for providing a signal representative of a sensed bulk fluid temperature $T_{BULK}$ of the process fluid to the burner controller means 300. The burner controller means 300 advantageously further comprises means for comparing $T_{BULK}$ against preset upper $T_{HIGH}$ and lower $T_{LOW}$ temperature setpoints, and would then produce a control signal for controlling the burner array 114 to maintain the sensed bulk fluid temperature $T_{BULK}$ of the process fluid 152 substantially within an operating range defined by the preset upper $T_{HIGH}$ and lower $T_{LOW}$ temperature setpoints based upon a result of said comparison.

Further, it is envisioned that when a burner array 114 as shown in FIGS. 3–5 is utilized, sequential and/or controlled firing of the burner elements 118 in the array 114 may be used to maintain a particular temperature level within both the burner chamber 112 and the process fluid 152. The burner elements 118 may be fired in a low-medium-high sequence, such as by selectively firing one, two, three or more rows of burner elements 118 at a time, to control the heat input into the burner chamber 112 and achieve the desired sensed bulk fluid temperature $T_{BULK}$ of the process fluid 152. Proper control of the heat input into the process fluid also helps prevent scaling and other fouling on the condenser side 142 of the thermosyphons 106. The fuel input to each of the rows of burner elements 118 in the entire burner array 114 may thus be individually controlled on a row by row basis by controlling gas valve means 126 operatively associated with each row to reduce the number of active rows of burner elements 118 when the temperature sensor 310 indicates the process fluid 152 is too warm, relative to a preset, upper temperature setpoint $T_{HIGH}$ and to fire additional rows of burner elements 118 when the process fluid 152 is too cool, relative to a preset burner temperature setpoint, $T_{LOW}$. The value of $T_{HIGH}$ would generally be selected to be sufficiently different from $T_{LOW}$ to prevent unnecessary burner controller means 300 oscillations. Even if row by row control is used, the fuel flow from fuel source 120 to an active row could still be modulated. Known temperature feedback control system sensor and control elements may be used for this purpose.

Another type of control system approach which could be used with the burner array 114 would be to modulate the fuel flow 120 to all of the burner elements 118 as a group by means of the gas valve means 126, based upon a sensed temperature measured by the temperature sensor 310. As above, when the sensed bulk fluid temperature $T_{BULK}$ exceeds or is below a preset temperature setpoint level or value, the fuel flow 120 may be restricted or increased to all of the burner elements 118 in the burner array 114 as a whole, to affect the heat output of the entire burner array 114. Burner controller means 300 would effect this result by controlling the gas valve means 126 as needed.

In both types of temperature control system approaches, it is preferred that an outer diameter outside surface temperature $T_{OD}$ of the condenser ends 142 of the thermosyphons 106 is monitored by the temperature sensor 306, and that the measured value of $T_{OD}$ is compared to a preset temperature setpoint limit $T_{ALARM}$. The particular value of $T_{ALARM}$ would be selected to be greater than $T_{HIGH}$ so that the normal burner modulating features of the burner controller 300 which occur as it attempts to maintain $T_{BULK}$ within the desired operating range would not be affected. However, when the sensed temperature $T_{OD}$ exceeds the preset temperature setpoint a $T_{ALARM}$, the burner controller 300 would act to shut down all of the burner elements 118 in the burner array 114 to prevent scaling and fouling of the condenser ends 142 of the thermosyphons 106. In this case, burner controller means 300 would effect this result by controlling the gas valve means 126 to shut off the flow of fuel 120 to the burner array 114. While temperature sensor 306 is shown in FIGS. 3 and 5 as being on a condenser end 142 of a lowermost thermosyphon tube 106, it is understood that the temperature sensor 306 could be located on any condenser end 142 of any thermosyphon tube 106.

Figure 12:
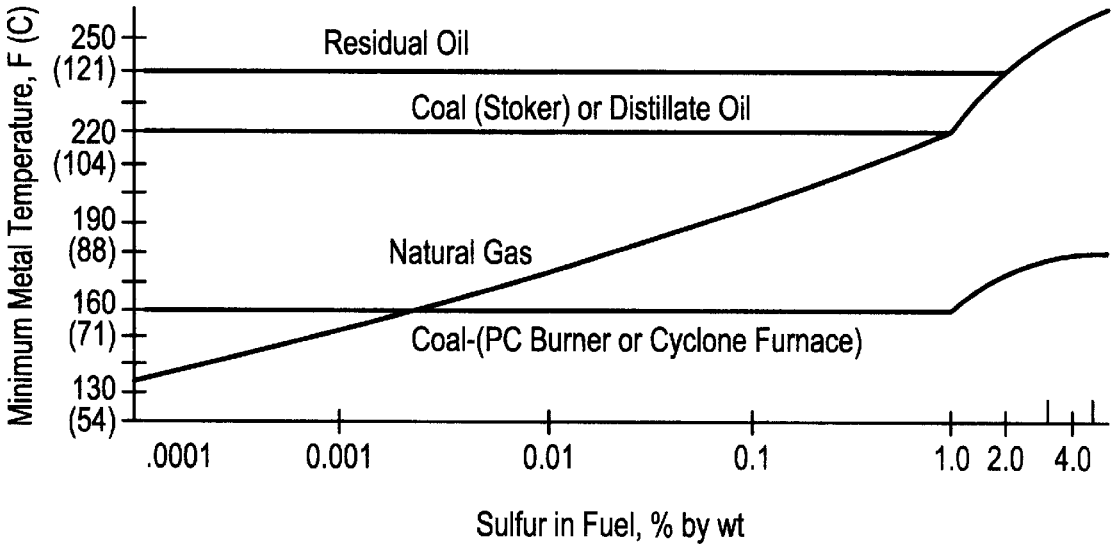
FIG. 12 is a graph of minimum metal temperatures to prevent corrosion as a function of the type of fuel and percent sulfur therein.

In addition to the means for controlling the heat input into the process fluid 152, control of cold end corrosion on the evaporator ends 104 can also be achieved via the burner control means 300. As schematically indicated in FIGS. 3 & 5, the burner control means 300 may also perform this function, being operatively interconnected via line 302 to the gas valve means 126 and via a line 312 to a third temperature sensor 314 located on at least one of the evaporator ends 104. Generally, this will be the row of thermosyphon tubes 106 furthest away from the burner array 114 but the temperature sensor means 314 may be located on any evaporator end 104 of any thermosyphon tube 106. Since the burner control means 300 is advantageously microprocessor based, means for inputting and changing any of the particular temperature setpoints $T_{SETPOINT}$ by a human operator can readily be provided. Thus, temperature sensor means 314 would provide a signal representative of a sensed evaporator end 104 outside metal temperature $T_{EVAP}$ which would be conveyed via line 312 to the burner control means 300. Burner control means 300 would then compare the sensed outside metal temperature $T_{EVAP}$ against a preset temperature setpoint $T_{DEW}$, which corresponds to the water or sulfuric acid dewpoint temperature of the combustion gases in the burner chamber 112, and produce a control signal as a result of that comparison. That control signal would be used to control the burner array 114 to maintain the sensed outside metal temperature $T_{EVAP}$ the evaporator ends 104 substantially above the preset temperature setpoint $T_{DEW}$ to prevent cold end corrosion. Determination of $T_{DEW}$ depends upon the moisture and sulfur content of the fuel gases burned in the burner array 114, as illustrated in FIG. 12, which is taken from Chapter 19 of *STEAM its generation and use*, 40$^{th}$ Edition, Stultz & Kitto, Eds., Copyright© 1992, The Babcock & Wilcox Company, Barberton, Ohio, U.S.A. The ability of the burner control means 300 to maintain the metal temperature $T_{EVAP}$ of the evaporator ends 104 above the $T_{DEW}$ temperature setpoint will prevent corrosion of these evaporator ends 104, thus preventing loss of thermal efficiency and possible failure of the thermosyphons 106.

On a fuel consumed basis, the present invention is 1.5 to 2.5 times more efficient than a fire tube heating system (75 to 85% efficiency for the invention, versus 35 to 55% for a conventional fire tube heating system). For the same heat input duty, the thermosyphons of the present invention have 2–3 times more surface area than a conventional fire tube heater and yet they take up to 10 times less volume. This allows for more room for product processing or storage within the process fluid tank or vessel 150, 190. The increased fuel efficiency means that less fuel will be burned; burning less fuel means lower emissions. It is believed that the present invention,employing T-type or up shot burner elements 118, will produce 1.5 to 2.5 times less $NO_x$ and virtually zero CO for the same heat input duty. However, of particular importance is the fact that the use of such burner elements 118, in combination with the thermosyphon features of the present invention, allows the use of casing gas (if available at the site) as the fuel input source 120. This provides an additional emission and fuel savings since the invention can use/bum a casing gas which normally is vented to atmosphere, and at a reduced (1.5 to 2.5 times) rate of consumption. Being able to utilize casing gas as the fuel input source 120 is a major cost savings because casing gas is essentially "free" to the producers (oil/gas) at sites as a normal byproduct of the oil extraction process.

While specific embodiments of the invention have been shown and described in detail to illustrate the application of the principles of the invention, it will be understood that the invention may be embodied otherwise without departing from such principles. For example, the present invention may be applied to new construction involving process fluid heating tanks or vessels, or to the replacement, repair, or modification of existing process fluid heating tanks or vessels. Thus, in some embodiments of the invention, certain features of the invention may sometimes be used to advantage without a corresponding use of the other features. Accordingly, all such changes and embodiments properly fall within the scope and equivalents of the following claims.

We claim:

1. An apparatus for controlled heating of a process fluid, comprising:

a heater having a burner chamber, a burner array in the burner chamber, and means for providing combustion air to the burner array;

a process fluid vessel for containing the process fluid;

a plurality of thermosyphons having evaporator ends and condenser ends, the evaporator ends arranged in a closely spaced bundle within the burner chamber in close proximity to the burner array, the condenser ends extending into the process fluid vessel, whereby the evaporator ends receive heat generated by the burner array within the burner chamber, and the heat is transferred through the thermosyphons to the condenser ends which are arranged to release heat into the process fluid in the process fluid vessel; and burner controller means for controlling an amount of fuel supplied from a fuel source to the burner array in response to sensed temperatures, the burner controller means operative to shut off a flow of fuel to the burner array when a sensed temperature $T_{OD}$, corresponding to an outside diameter outside surface temperature of at least one of the condenser ends of the thermosyphons extending into the process fluid vessel, exceeds a predetermined setpoint temperature $T_{ALARM}$.

2. The apparatus for controlled heating of a process fluid according to claim 1, wherein the heater further comprises preheat means for preheating the combustion air.

3. The apparatus for controlled heating of a process fluid according to claim 1, wherein the burner array comprises a plurality of one of T-type burners and up shot burners arranged in aligned rows.

4. The apparatus for controlled heating of a process fluid according to claim 1, wherein the condenser ends of the thermosyphons are arranged in wider spaced apart arrays within the process fluid vessel, relative to a spacing of the evaporator ends of the thermosyphons in the burner chamber, to produce a wide open, spread-out configuration of the condenser ends.

5. The apparatus for controlled heating of a process fluid according to claim 1, further comprising transition means for sealing the process fluid vessel from the burner chamber such that only the thermosyphons connect an interior of the burner chamber to an interior of the process fluid vessel, the transition means including a transition box connected between the burner chamber and the process fluid vessel and located around the thermosyphons, the transition box having at least one divider plate for dividing the transition box and separating the process fluid vessel and burner chamber, the divider plate having sealing means for making a sealed connection with the thermosyphons passing through the divider plate.

6. The apparatus for controlled heating of a process fluid according to claim 5, wherein the sealing means comprises a plurality of threaded collars, each collar sealedly connected around one of the plurality of thermosyphons, each threaded collar inserted through and making a sealed threaded connection with the divider plate.

7. The apparatus for controlled heating of a process fluid according to claim 5, wherein the sealing means comprises a plurality of collars, each collar positioned around and sealed to one of the plurality of thermosyphons, each collar inserted through and sealed to the divider plate.

8. The apparatus for controlled heating of a process fluid according to claim 5, wherein the sealing means comprises a seal weld between each one of the plurality of thermosyphons and the divider plate.

9. The apparatus for controlled heating of a process fluid according to claim 1, further comprising means for providing a signal representative of a sensed bulk fluid temperature $T_{BULK}$ of the process fluid to the burner controller means, means for comparing $T_{BULK}$ against preset upper $T_{HIGH}$ and lower $T_{LOW}$ temperature setpoints, and means for controlling the burner array to maintain the sensed bulk fluid temperature $T_{BULK}$ of the process fluid substantially within an operating range defined by the preset upper $T_{HIGH}$ and lower $T_{LOW}$ temperature setpoints based upon a result of said comparison.

10. The apparatus for controlled heating of a process fluid according to claim 1, further comprising means for providing a signal representative of a sensed evaporator end outer metal temperature $T_{EVAP}$ of the thermosyphons to the burner controller means, means for comparing $T_{EVAP}$ against a preset $T_{DEW}$ temperature setpoint, and means for controlling the burner array to maintain the sensed evaporator end outer metal temperature $T_{EVAP}$ of the thermosyphons substantially above the preset $T_{DEW}$ temperature setpoint based upon a result of said comparison.

11. The apparatus for controlled heating of a process fluid according to claim 1, further comprising: plural burner elements in the burner array; gas valve means operatively associated with all of the plural burner elements for modulating the amount of fuel supplied to all of the plural burner elements in the burner array as a whole; and wherein the burner controller means controls the gas valve means to modulate the amount of fuel supplied to the burner array as a whole in response to the sensed temperatures.

12. The apparatus for controlled heating of a process fluid according to claim 1, further comprising: plural rows of burner elements in the burner array; gas valve means operatively associated with each row of burner elements for modulating the amount of fuel supplied to each row; and wherein the burner controller means selectively controls the gas valve means for each row to individually modulate the amount of fuel supplied to each row of burner elements in the burner array in response to the sensed temperatures.

* * * * *